US008312961B2

(12) United States Patent
Won et al.

(10) Patent No.: US 8,312,961 B2
(45) Date of Patent: Nov. 20, 2012

(54) SOOT PREVENTING TYPE TAIL TRIM

(75) Inventors: Jongseung Won, Gunpo-si (KR); Hoejo Jeong, Gunpo-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 116 days.

(21) Appl. No.: 12/954,896

(22) Filed: Nov. 28, 2010

(65) Prior Publication Data

US 2012/0085837 A1 Apr. 12, 2012

(30) Foreign Application Priority Data

Oct. 8, 2010 (KR) ..... 10-2010-0098113

(51) Int. Cl.

| | |
|---|---|
| ***F01N 3/02*** | (2006.01) |
| ***F01N 13/08*** | (2010.01) |
| ***B05B 1/28*** | (2006.01) |
| ***B60K 13/04*** | (2006.01) |
| ***B60R 19/02*** | (2006.01) |

(52) U.S. Cl. ..... 181/227; 60/309; 180/309; 181/228; 239/105; 293/113

(58) Field of Classification Search ..... 181/227; 60/309; 239/105; 293/113
See application file for complete search history.

(56) References Cited

U.S. PATENT DOCUMENTS

| | | | | |
|---|---|---|---|---|
| 2,841,232 | A * | 7/1958 | Loeffler | 180/89.2 |
| 2,979,357 | A * | 4/1961 | Leach et al. | 293/113 |
| 4,638,632 | A * | 1/1987 | Wulf et al. | 60/319 |
| 5,466,900 | A * | 11/1995 | Knapp | 181/227 |
| 6,006,859 | A * | 12/1999 | Hussaini | 181/227 |
| 6,595,318 | B2 * | 7/2003 | Ebinger et al. | 181/227 |
| 6,827,173 | B2 * | 12/2004 | Lai | 180/309 |
| 7,007,720 | B1 * | 3/2006 | Chase et al. | 138/110 |
| 7,032,702 | B2 * | 4/2006 | Rinklin | 180/309 |
| 7,604,092 | B2 * | 10/2009 | Fritz | 181/227 |
| 7,735,885 | B2 * | 6/2010 | Shin | 293/113 |
| 2008/0036222 | A1 * | 2/2008 | Iwamoto et al. | 293/113 |
| 2011/0239637 | A1 * | 10/2011 | Ochsner et al. | 60/320 |
| 2012/0073275 | A1 * | 3/2012 | Han et al. | 60/309 |

FOREIGN PATENT DOCUMENTS

| | | | |
|---|---|---|---|
| JP | 63-295814 | A | 12/1988 |
| JP | 10-331631 | A | 12/1998 |
| JP | 2005-256688 | A | 9/2005 |
| KR | 10-0461076 | B1 | 12/2004 |
| KR | 10-0766806 | B1 | 10/2007 |
| KR | 10-0853583 | B1 | 8/2008 |
| KR | 10-2009-0108578 | A | 10/2009 |
| KR | 10-2009-0129712 | A | 12/2009 |

* cited by examiner

*Primary Examiner* — David Warren
*Assistant Examiner* — Christina Russell
(74) *Attorney, Agent, or Firm* — Morgan, Lewis & Bockius LLP

(57) ABSTRACT

A soot preventing type tail trim may include a tail pipe discharging exhaust gas, and a body enclosing an outer circumference of the tail pipe with a predetermined space therebetween, such that wind may be allowed to flow into the predetermined space and to be discharged therefrom to generate a separation layer in the exhaust gas passing the tail pipe by the wind.

4 Claims, 3 Drawing Sheets

CROSS-SECTION A-A

SOOT PREVENTING TYPE TAIL TRIM

CROSS-REFERENCE TO RELATED APPLICATIONS

The present application claims priority to Korean Patent Application Number 10-2010-0098113 filed Oct. 8, 2010, the entire contents of which application is incorporated herein for all purposes by this reference.

BACKGROUND OF THE INVENTION

1. Field of the Invention

The present invention relates to a tail trim, and more particularly, to a tail trim that can prevent adhesion of soot contained in exhaust gas.

2. Description of Related Art

In general, tail pipes at the end of exhaust pipe discharging exhaust gas into the atmosphere are exposed to the outside, under the rear bumper.

The tail pipes exposed to the outside, as described above, should be appropriately finished for the external appearance of vehicles, and as an example of the finishing, polishing is used for the tail trim having improved aesthetic appearance and satisfaction.

The tail trim has a simple structure of a hollow pipe type and fitted on the tail pipe, thereby completing assembly.

If needed, it is possible to increase fixing force between the tail trim and the tail pipe by welding them.

However, the exhaust gas passing through the tail pipe is discharged through the tail trim and diffused in the atmosphere and the diffusion of the exhaust gas cause a change of the color of the tail trim by directly bringing soot in contact with the end portion of the tail trim.

The change of color of the tail trim considerably detracts from the aesthetic appearance by removing luster, which causes an effect against the usage of the tail trim for improving the aesthetic satisfaction.

In particular, the tail trim used for the tail pipes of diesel vehicles that produce a large amount of soot, as compared with gasoline vehicles, more quickly remove luster and change the color due to the soot, such that the aesthetic satisfaction effect from the tail trim is necessarily rapidly reduced.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a tail trim that can reduce contamination due to adhesion of soot by changing diffusion flow of exhaust gas discharged into the atmosphere due to inflow of wind to the exhaust gas.

In an aspect of the present invention, the soot preventing type tail trim may include a tail pipe discharging exhaust gas, and a body enclosing an outer circumference of the tail pipe with a predetermined space therebetween, such that wind may be allowed to flow into the predetermined space and to be discharged therefrom to generate a separation layer in the exhaust gas passing the tail pipe by the wind.

The soot preventing type tail trim may further include a wind inlet formed between an end portion of the body and the outer circumference of the tail pipe and having at least one or more openings to allow the wind to flow therethrough inside the predetermined space, the body formed of a hollow pipe having the predetermined space therein, wherein an external finishing portion may be formed to the other end of the body and connected to a distal end portion of the tail pipe, and at least a slot formed through the tail pipe at the distal end portion of the tail pipe.

An inner diameter of the tail pipe at the distal end portion thereof may be larger than a diameter at a proximate end thereof disposed near to the wind inlet.

A cross section of an inner space of the predetermined space formed near to the other end of the body pipe may be smaller than a cross section of an inner space thereof formed near to the one end of the body.

The openings and the slots may be symmetric in a pair.

The external finishing portion may be tapered.

According to the exemplary embodiment of the present invention, it s possible to prevent soot in exhaust gas from adhering by using wind, such that it is possible to keep long the effect of the tail trim for improving aesthetic satisfaction.

Further, it is possible to reduce the weight and manufacturing cost of the tail trim by forming the channels for wind.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
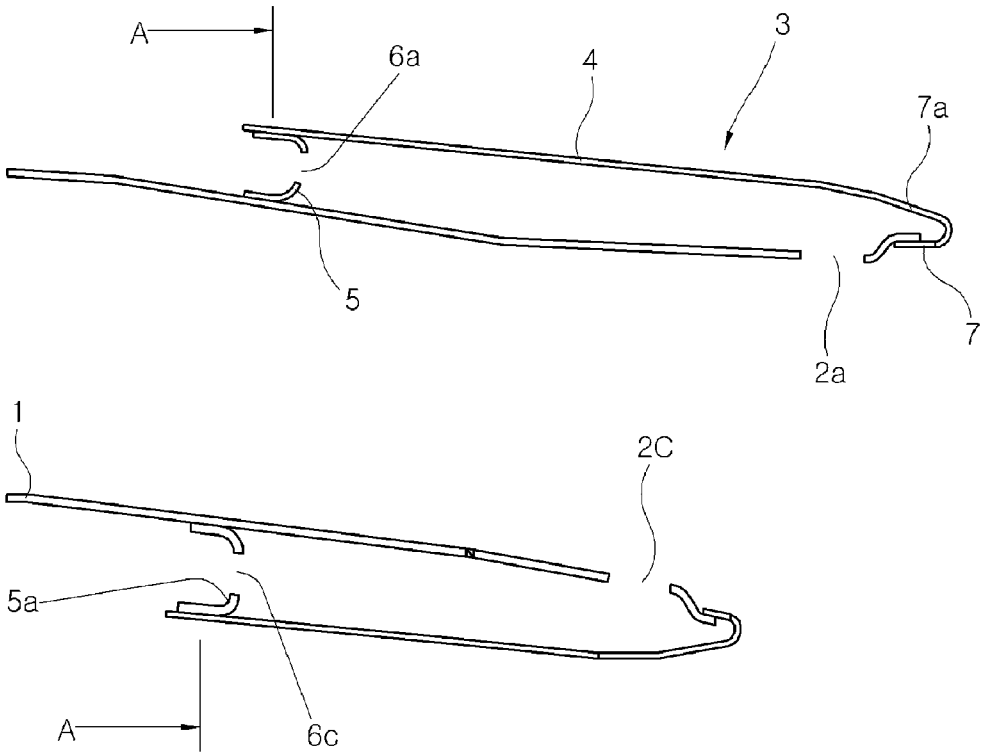
FIG. 1 is a cross-sectional view showing the configuration of a tail pipe equipped with a soot preventing type tail trim according to an exemplary embodiment of the present invention.
Figure 1:
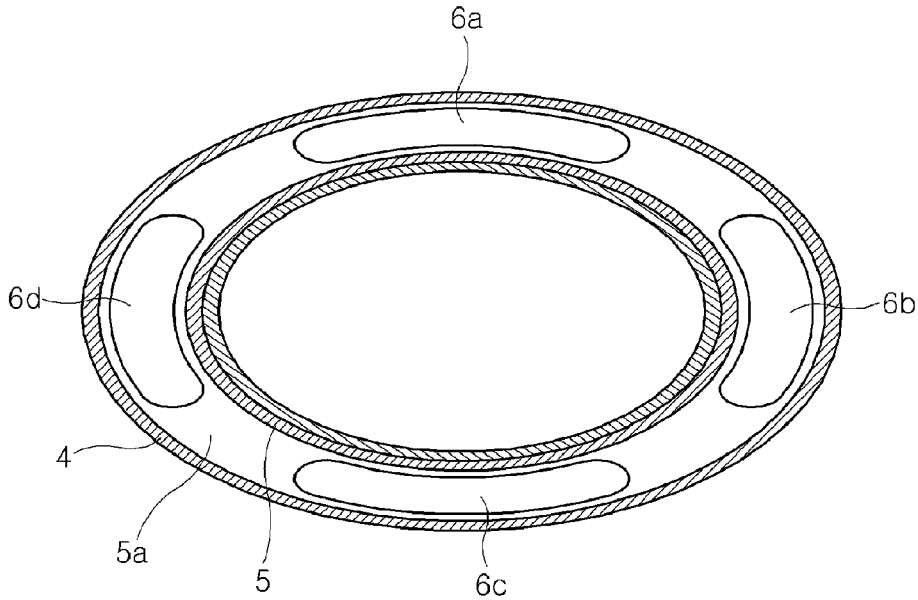

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Referring to FIG. 1, a tail pipe 1 is a hollow pipe forming the end portion of an exhaust pipe and a tail trim 3 is made of a shiny material and covers tail pipe 1 to improve aesthetic appearance and satisfaction.

In the exemplary embodiment, tail pipe 1 communicates with tail trim 3, such that soot cannot adhere to tail trim 3 by wind.

For this configuration, tail trim 3 has a body 4, which is a hollow pipe, and a wind inlet 5 is formed at one end of body 4 and an external finishing portion 7 is formed at the opposite end of body 4.

As described above, tail trim 3 has a structure with both ends, which are narrow inlet, and a large internal space, because wind inlet 5 and external finishing portion 7 which bend at left and right ends of body 4, respectively, have diameters smaller than body 4.

Wind inlet 5 forms a diameter-reducing surface 5*a* formed by bending inward the end of body 4 and at least one or more holes are formed through diameter-reducing surface 5*a*.

The holes include first, second, third, and fourth holes 6*a*~6*d* that are symmetric at 90° from each other in a pair, as shown in the cross-sectional view taken along the line A-A of FIG. 1, and have elliptical shapes.

Although the number of openings is limited to four and the shape is limited to the elliptical shape in the exemplary embodiment, the openings may be formed in appropriate number and various shapes, throughout the circumference.

External finishing portion 7 is tapered with an inclined surface 7*a*.

Figure 2:
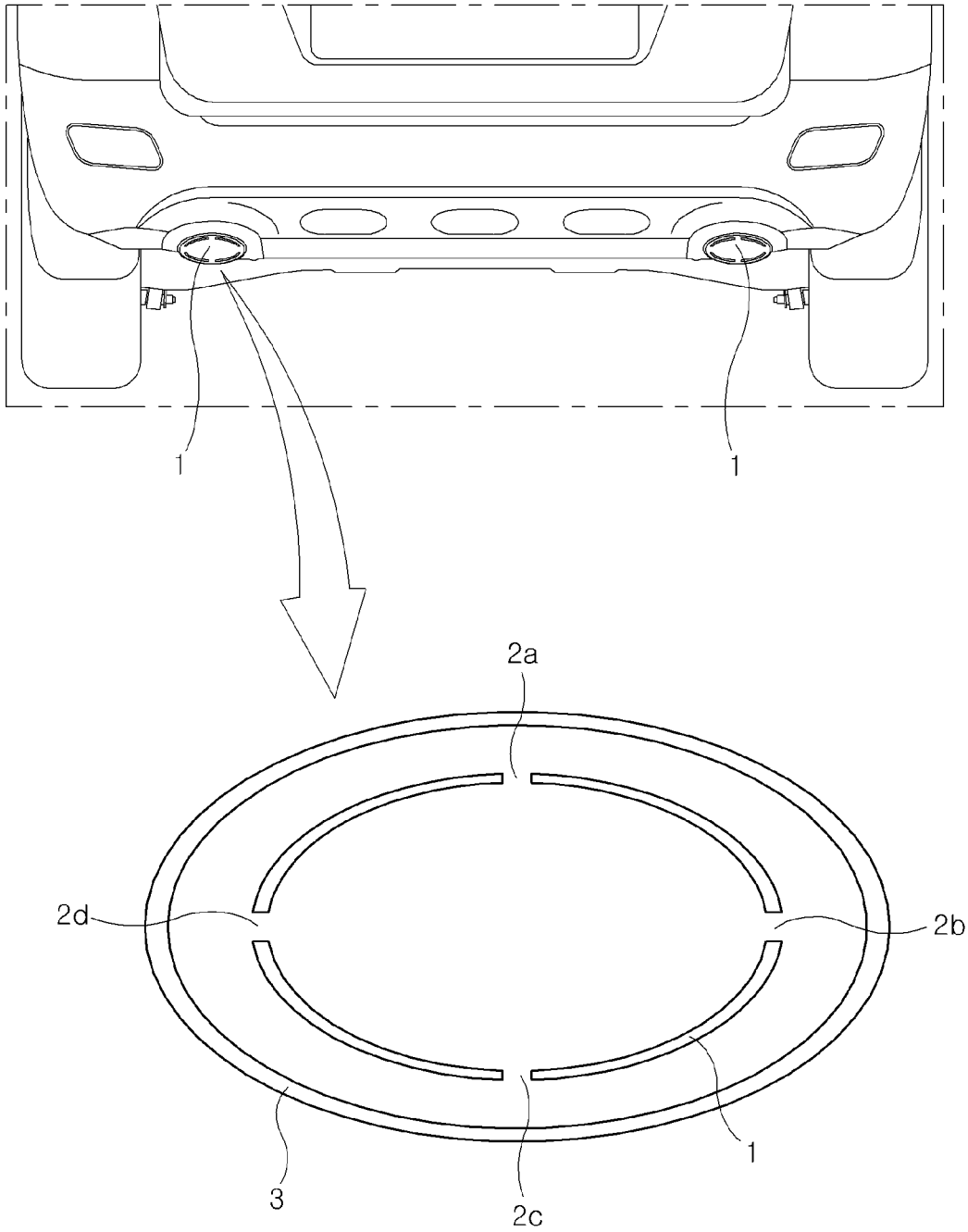
FIG. 2 is a view showing when the tail trim according to an exemplary embodiment of the present invention is mounted on a tail pipe.

FIG. 2 shows a tail pipe combined with the tail trim according to an exemplary embodiment of the present invention.

As shown in FIG. 2, one or more slots are formed in rectangular cross-sections through the end of the tail pip.

The slots include first, second, third, and fourth slots 2*a*~2*d* that are symmetric at 90° from each other, in a pair.

Although the number of slots is limited to four and the shape is limited to the rectangular shape in the exemplary embodiment, the slots may be formed in appropriate number and various shapes, throughout the circumference.

Referring to FIG. 1 again, tail trim 3 covers the end portion of tail pipe 1, with body 4, which is a hollow pipe, and fixed in close contact to the outer circumference of tail pipe 1 by wind inlet 5 bending at the left end of body 4 and fixed to the end of tail pipe 1 by external finishing portion 7 bending at the right end of body 1.

Since tail trim 3 covers the end of tail pipe 1, tail trim 3 forms an empty space by using body 4 spaced apart from the outer circumference of tail pipe 1.

As described above, the empty space defined inside tail trim 3 functions as a channel connecting tail trim 3 with tail pipe 1.

Figure 3:
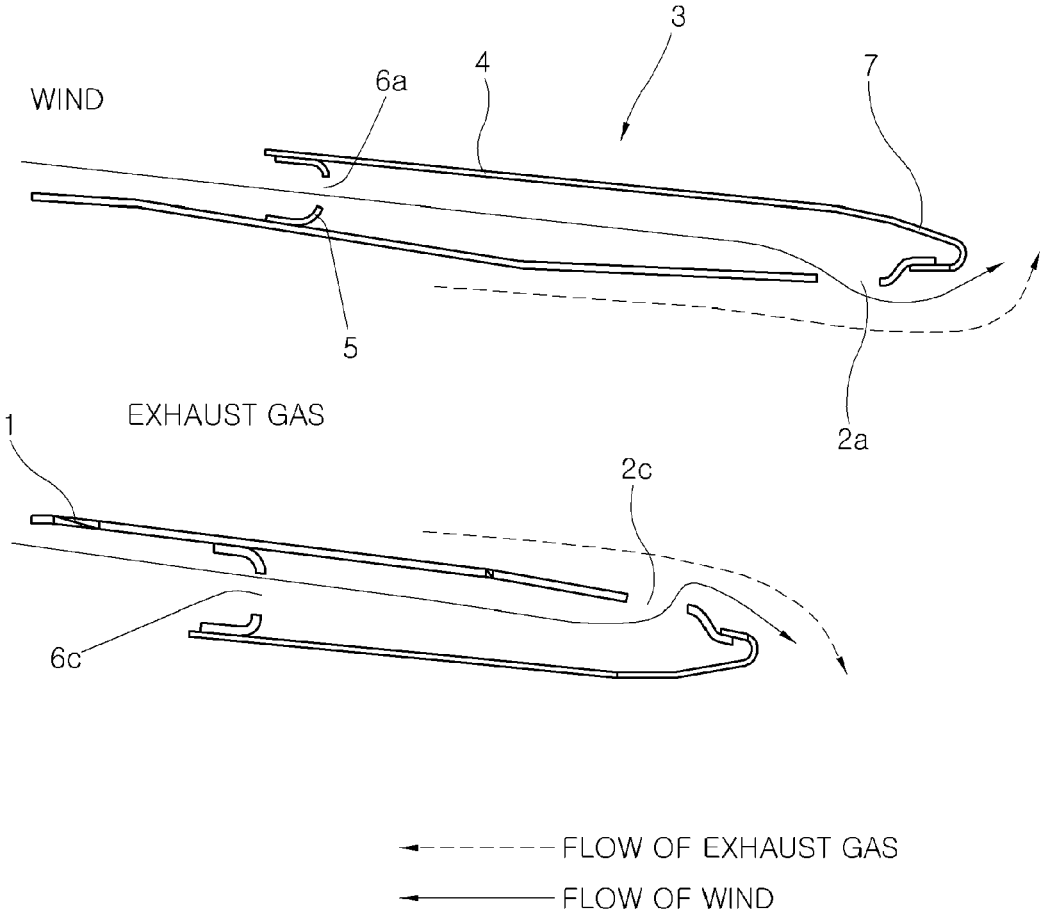
FIG. 3 is a view showing flow of exhaust gas due to wind passing through the tail trim according to an exemplary embodiment of the present invention.

FIG. 3 is a view showing flow of exhaust gas due to wind passing through the tail trim according to an exemplary embodiment of the present invention.

As shown in FIG. 3, the wind passing tail trim 3 is generated around a vehicle traveling, and some of the wind hits against wind inlet 5 of tail trim 3 and flows into first, second, third, and fourth holes 6*a*~6*d* formed through wind inlet 5.

The wind flowing inside through first, second, third, and fourth holes 6*a*~6*d* flows into the empty space inside tail trim 3 covering tail pipe 1 and the wind that has flowed in the empty space flows into a space inside tail pipe 1 through first, second, third, and fourth slots 2*a*~2*d* of tail pipe 1.

As described above, the wind coming out of tail trim 3 pushes exhaust gas to the center of tail pipe 1, such that separation layers are generated at the end of tail trim 3. Therefore, it prevents the exhaust gas discharged into the atmosphere from directly contacting the end portion of tail trim 3, and accordingly, it is possible to soot changing or removing the color of tail trim 3 from adhering.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A soot preventing type tail trim, comprising:

a tail pipe discharging exhaust gas; and a body enclosing an outer circumference of the tail pipe with a predetermined space therebetween, such that wind is allowed to flow into the predetermined space and to be discharged therefrom to generate a separation layer in the exhaust gas passing the tail pipe by the wind;

a wind inlet formed between an end portion of the body and the outer circumference of the tail pipe and having at least one or more openings to allow the wind to flow therethrough inside the predetermined space, wherein the wind inlet includes a diameter-reducing surface bent toward the other end of the body and the at least one or more openings are formed to the diameter-reducing surface;

the body formed of a hollow pipe having the predetermined space therein, wherein an external finishing portion is formed to the other end of the body and connected to a distal end portion of the tail pipe; and at least a slot formed through the tail pipe at the distal end portion of the tail pipe, wherein an inner diameter of the tail pipe at the distal end portion thereof is larger than a diameter at a proximate end thereof disposed near to the wind inlet.

2. The soot preventing type tail trim as defined in claim 1, wherein a cross section of an inner space of the predetermined space formed near to the other end of the body is smaller than a cross section of an inner space thereof formed near to the one end of the body.

3. The soot preventing type tail trim as defined in claim 1, wherein the openings and the slots are symmetric in a pair.

4. The soot preventing type tail trim as defined in claim 1, wherein the external finishing portion is tapered.

* * * * *